US010362887B2

(12) United States Patent
Russo

(10) Patent No.: US 10,362,887 B2
(45) Date of Patent: Jul. 30, 2019

(54) APPARATUSES AND METHODS FOR PLACING A COVERING ABOUT A MATTRESS

(71) Applicant: Russo Inventions, LLC, Grand Rapids, MI (US)

(72) Inventor: Scott S. Russo, Grand Rapids, MI (US)

(73) Assignee: Russo Inventions, LLC, Grand Rapids, MI (US)

( * ) Notice: Subject to any disclaimer, the term of this patent is extended or adjusted under 35 U.S.C. 154(b) by 765 days.

(21) Appl. No.: 14/990,890

(22) Filed: Jan. 8, 2016

(65) Prior Publication Data

US 2016/0198863 A1 Jul. 14, 2016

Related U.S. Application Data

(60) Provisional application No. 62/101,149, filed on Jan. 8, 2015.

(51) Int. Cl.
*A47G 9/02* (2006.01)
*A47C 21/02* (2006.01)

(52) U.S. Cl.
CPC ..... *A47G 9/0246* (2013.01); *A47C 21/028* (2013.01)

(58) Field of Classification Search
CPC ..... A47C 21/02; A47C 21/022; A47C 21/026; A47C 21/028; A47G 9/0246; A47G 2009/0269; Y10T 24/23
See application file for complete search history.

(56) References Cited

U.S. PATENT DOCUMENTS 1,833,298 A * 11/1931 Oakey ..... A47C 21/022 160/349.1
2,129,487 A * 9/1938 Bleier ..... A47C 21/022 24/72.5
2,281,736 A * 5/1942 Wittenburg ..... B68G 15/00 81/488
2,284,778 A * 6/1942 Treiber ..... A47C 21/022 297/224
2,972,756 A * 2/1961 Monier ..... A47G 9/0246 5/496
2,973,526 A * 3/1961 Wetzler ..... A47C 21/022 5/737
2,979,737 A * 4/1961 Gerald ..... A47C 21/028 5/498

(Continued)

*Primary Examiner* — Nicholas F Polito
*Assistant Examiner* — Ifeolu A Adeboyejo
(74) *Attorney, Agent, or Firm* — Price Heneveld LLP

(57) ABSTRACT

An apparatus and method for manipulating a covering such as a bed sheet are provided. The apparatus, in one form, includes a proximal grip portion and a distal covering engaging portion including a plurality of spaced-apart protrusions for engaging with corresponding spaced-apart openings in the covering. The apparatus includes end stop portions adjacent to the protrusions for limiting how far the protrusions may extend through the openings in the covering. A tool receiving portion of the covering may take the form of a pocket or spaced-apart openings that are located in at least one corner portion of the cover. The installation tool engages with the openings in the covering to manipulate the cover and reduces the need to bend over or crouch down to reach around or underneath the mattress when placing the sheet about the mattress.

7 Claims, 9 Drawing Sheets

(56) References Cited

U.S. PATENT DOCUMENTS 2,982,976 A * 5/1961 Ferolito ..... A47C 21/022 5/484
3,520,030 A * 7/1970 Hawkins ..... A47C 21/026 24/72.5
3,818,519 A * 6/1974 Schuder ..... A47C 21/026 5/236.1
4,317,245 A * 3/1982 El-Amin ..... A47G 9/0246 5/496
4,344,196 A * 8/1982 Large ..... A47G 9/0246 5/496
D268,073 S 3/1983 Schaeffer
D268,804 S 5/1983 Bacon
D275,540 S 9/1984 Barkow
4,486,909 A * 12/1984 McKneelan ..... A47C 21/022 24/72.5
4,520,518 A * 6/1985 Reaser ..... A47C 21/022 24/72.5
4,521,970 A * 6/1985 Jester ..... A47C 21/022 24/114.3
4,535,496 A * 8/1985 Parker ..... A47C 21/028 29/270
4,624,022 A * 11/1986 Dolan ..... A47C 21/022 24/72.5
4,686,726 A * 8/1987 Dunfee ..... A47C 21/022 5/485
4,745,650 A 5/1988 Elliott
4,782,543 A * 11/1988 Hutton ..... A47C 21/022 24/72.5
4,890,345 A * 1/1990 Sessa ..... A47C 21/028 24/72.5
4,899,404 A * 2/1990 Galumbeck ..... A47C 20/04 16/366
4,901,388 A * 2/1990 Irwin ..... A47C 21/022 24/72.5
4,916,766 A * 4/1990 Grandy ..... A47C 21/022 5/496
4,937,904 A * 7/1990 Ross ..... A47C 21/022 24/72.5
5,020,177 A 6/1991 Etherington
5,099,531 A * 3/1992 Schmier ..... A47C 21/022 5/494
5,161,276 A * 11/1992 Hutton ..... A47C 21/022 24/72.5
5,191,664 A * 3/1993 Wyatt ..... A47C 21/022 24/72.5
5,321,862 A * 6/1994 Campbell ..... A47C 21/022 5/482
5,394,579 A * 3/1995 Walters ..... A47C 21/022 24/115 G
5,467,491 A * 11/1995 Griffith ..... A47C 21/022 24/72.5
5,884,349 A 3/1999 Gretsinger
6,108,836 A 8/2000 Keene, III
6,161,235 A 12/2000 Smith et al.
6,243,895 B1 6/2001 Amin
D493,078 S 7/2004 McGee et al.
7,398,569 B2 7/2008 Sakaldasis et al.
7,487,561 B2 2/2009 Ho
7,669,257 B2 * 3/2010 Swihart ..... A47G 9/02 5/496
7,730,567 B2 6/2010 Jaeger
D622,569 S 8/2010 Montross
7,818,837 B2 10/2010 Gonser, Jr.
8,191,191 B2 6/2012 Montross
2002/0062524 A1 * 5/2002 Vogland ..... A47C 21/022 5/692
2005/0125903 A1 * 6/2005 Tapanes ..... A47C 21/022 5/694
2006/0000061 A1 * 1/2006 Ota ..... A47C 21/022 24/72.5
2007/0245495 A1 * 10/2007 Wang ..... A47C 21/022 5/706
2007/0283494 A1 12/2007 Vasey
2008/0040856 A1 2/2008 Adamson et al.
2008/0040858 A1 2/2008 Sadaldasis et al.
2008/0040859 A1 2/2008 Harris-Adamson et al.
2008/0052836 A1 3/2008 Harris Adamson et al.
2008/0134431 A1 * 6/2008 Piana ..... A47C 21/026 5/411
2008/0235878 A1 10/2008 Harris-Adamson et al.
2009/0172881 A1 * 7/2009 Peterson ..... A47C 21/022 5/496
2009/0229053 A1 9/2009 Amsler, Jr.
2009/0282656 A1 * 11/2009 Wong ..... A47C 21/022 24/700
2010/0175195 A1 7/2010 Harris Adamson et al.
2010/0275374 A1 * 11/2010 Hipp ..... A47G 9/0246 5/496
2012/0023675 A1 2/2012 Hutchison et al.
2013/0283528 A1 * 10/2013 Tzur ..... A47C 21/022 5/498

* cited by examiner

APPARATUSES AND METHODS FOR PLACING A COVERING ABOUT A MATTRESS

CROSS REFERENCE TO RELATED APPLICATION

This present application claims the benefit of U.S. Provisional Application No. 62/101,149 entitled "APPARATUSES AND METHODS FOR PLACING A COVERING ABOUT A MATTRESS" filed on Jan. 8, 2015, the entire contents of which are incorporated by reference.

FIELD OF THE INVENTION

This invention relates to apparatuses and methods for placing a covering, such as a bed sheet, about an object, such as a mattress.

BACKGROUND OF THE INVENTION

The process of making a bed can be physically taxing, as such a task usually requires bending over, lifting a portion of the mattress, and tucking bed covers underneath the mattress and between the mattress box spring or other support structure. This task can be especially difficult for people with physical disabilities, and particularly those with back pain/trauma or arthritis. Generally, beds are made manually without the aid of an apparatus for assistance. In an institutional setting, such as a hospital or nursing home, or other places having a large number of beds, such as hotels, the repetitive task of making beds can be especially strenuous, even for able-bodied individuals. In addition, the repetitive nature of making numerous beds can potentially lead to fatigue or injury.

A number of tools are known for assisting with the making of beds. Known tools are either designed for lifting the mattress for allowing sheets to be tucked under the mattress, or for tucking the sheet itself underneath the mattress. U.S. Pat. No. 7,398,569 to Sakaldasis et al. discloses two such tools. One tool has a handle and a wedge-shaped distal portion for being inserted between the mattress and the mattress support surface, such as a bed frame or a box spring, to lift up a portion of the mattress above the support surface. A separate tool having a handle and a distal tuck member with a planar configuration is used to tuck a flat sheet underneath the mattress.

SUMMARY OF THE INVENTION

In one embodiment, a tool for placing a sheet-like cover around an object, such as a mattress, includes a proximal handle portion, a distal end portion configured with a cover manipulating portion that includes a plurality of spaced-apart protrusions that extend away from the proximal handle portion. The protrusions are configured to engage with a tool receiving portion of a covering in the form of a plurality of spaced-apart openings in the covering so that the covering can be held and manipulated by the tool. The protrusions are preferably provided with end stop portions adjacent to the spaced-apart protrusions that are sized and configured for abutting with the covering adjacent to the openings of the covering to limit how far the protrusions can extend therethrough. In one form, the protrusions may take the form of prongs or tines that are connected to a shaft or a handle. In another form, the protrusions may be projections that extend from a planar member attached to the handle portion. In some forms, the protrusions extend in a reference plane transverse to a tool axis, such as a longitudinal axis that is defined between the proximal handle portion and the distal end portion.

The end stop portions in one form are relatively enlarged portions relative to the spaced-apart protrusions and are sized and configured to be larger than the size of the openings in the cover, such that the end stop portions will abut the covering and will not pass through the openings when the protrusions are inserted through the openings. In one form, the end stop portions take the form of arcuate or spherical bodies disposed adjacent the spaced-apart protrusions. In yet another form, the end stop portions may be the surfaces of the cover manipulating portions that are adjacent to the spaced-apart protrusions, such as a portion of the cover manipulating portion adjacent the spaced-apart protrusions having an increase in diameter or width of the spaced-apart protrusions.

In another form, a combination for providing a tucked bed cover about a mattress includes a sheet-like bed covering having four corner portions with a tool receiving portion in the form of a plurality of spaced-apart openings disposed in at least one of the corner portions, and an installation tool for placing the bed covering about a mattress. The installation tool may be of any of the forms described above, i.e., having a handle portion at a proximal end and a distal end having a cover-engaging portion which includes a plurality of spaced-apart protrusions sized and configured to be received within the spaced-apart openings in the cover for manipulating the bed covering at the at least one corner portion to place the bed covering about a mattress.

The bed covering may include grommets disposed about each of the spaced-apart openings for reinforcing the openings. In a preferred form, the bed covering further comprises a pair of spaced-apart openings disposed in each of the four corner portions. The bed covering may be a fitted mattress sheet, e.g., one having elastic disposed about all or some of the sheet edge for more closely fitting around a mattress. In one form, the bed covering may include one or more hook and loop fastener components (e.g. "VELCRO"™) disposed adjacent the pair of openings for releasably engaging with a complementary hook and loop fastener disposed on the mattress or an adjacent mattress support structure or another sheet. The cover may further include a top sheet that is attached to the bed covering, such as near the bottom portion of the sheet.

In another form, the bed covering tool receiving portion may include a pocket located at one or more corner portions of the bed covering for receiving a user's hand or a separate tool for manipulating the bed covering for simplifying the tucking of the bed covering about the mattress. The pocket includes and an upper open edge that is unattached to the bed covering, and one or more sides that are connected to the cover to form a partially enclosed pocket.

A method for placing a sheet-like bed covering about a mattress may include the steps of providing a bed covering having a tool receiving portion, such as a plurality of openings that are spaced-apart from one another and located at at least one corner of the bed covering, engaging the tool receiving portion at at least one corner of the bed covering by an installation tool having a proximal handle portion and a cover manipulating portion, such as a pair of protrusions at a distal end thereof with the protrusions received within an opening of the tool receiving portion, such as the plurality of openings, placing the engaged corner of the bed covering about a corner of the mattress, and withdrawing the installation tool from the tool receiving portion of the bed covering. The method may include other steps, including tucking at least one corner of the bed covering between the mattress and a structure beneath the mattress or placing the bed covering on top of the mattress prior to engaging the corner of the bed covering with the installation tool.

These and other features, advantages, and objects of the present device will be further understood and appreciated by those skilled in the art upon studying the following specification, claims, and appended drawings.

DETAILED DESCRIPTION OF EMBODIMENTS

Figure 1:
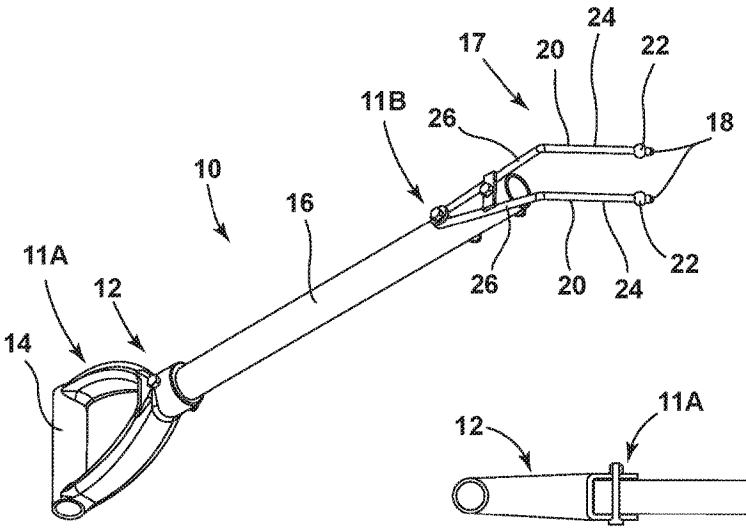
FIG. 1 is a perspective view of a tool for manipulating a bed covering.
Figure 2:
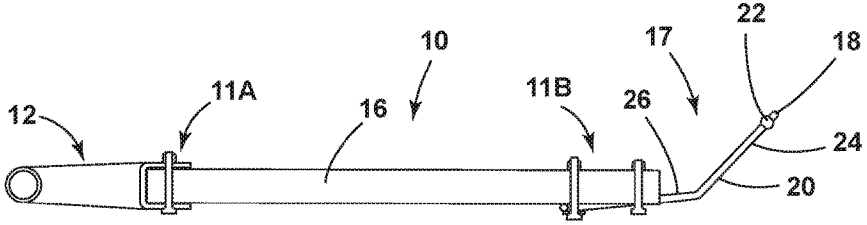
FIG. 2 is a side elevational view of the tool of FIG. 1.
Figure 3:
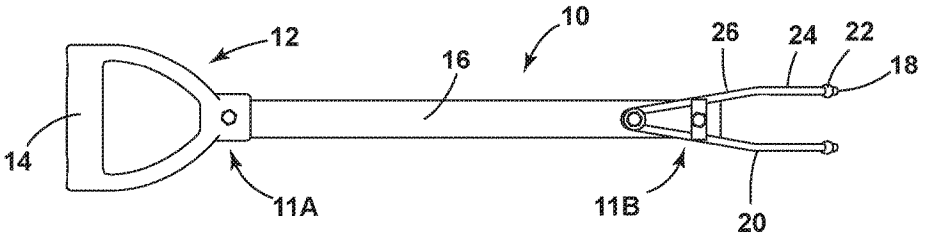
FIG. 3 is a bottom plan view of the tool of FIG. 1.
Figure 4:
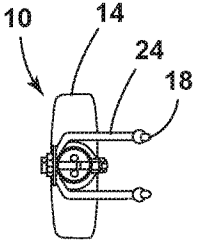
FIG. 4 is an end view of the tool of FIG. 1.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

In one form, a tool 10 for manipulating a bed covering is shown in FIGS. 1-4. The tool 10 includes a proximal handle portion 12 including a grip 14 connected to a tube-like shaft 16. The shaft 16 extends along a longitudinal axis between proximal and distal ends 11A, 11B. The distal tool end portion 11B includes a cover manipulating portion 17 having a pair of spaced-apart protrusions 18 at the distal ends of prongs or tines 20 that extend away from the proximal handle portion 12. The prongs 20 are connected to the distal end portion 11B of the shaft 16 via fasteners, or alternatively may be integrally formed on the shaft 16 to be of a unitary construction therewith. The prongs 20 include end stop portions 22 in the form of enlarged arcuate or spherical members located adjacent the spaced-apart protrusions 18. The end stop portions 22 are sized and configured for abutting with a bed covering adjacent to openings of the bed covering to limit how far the protrusions 18 may extend through the openings, as further described below. In the embodiment shown in FIGS. 1-4, the tool 10 includes two spaced-apart protrusions 18 at the distal ends of the prongs 20. It is contemplated that more or less protrusions 18 can be used with the tool 10 of the present invention without departing from the spirit of the invention.

Figure 5:
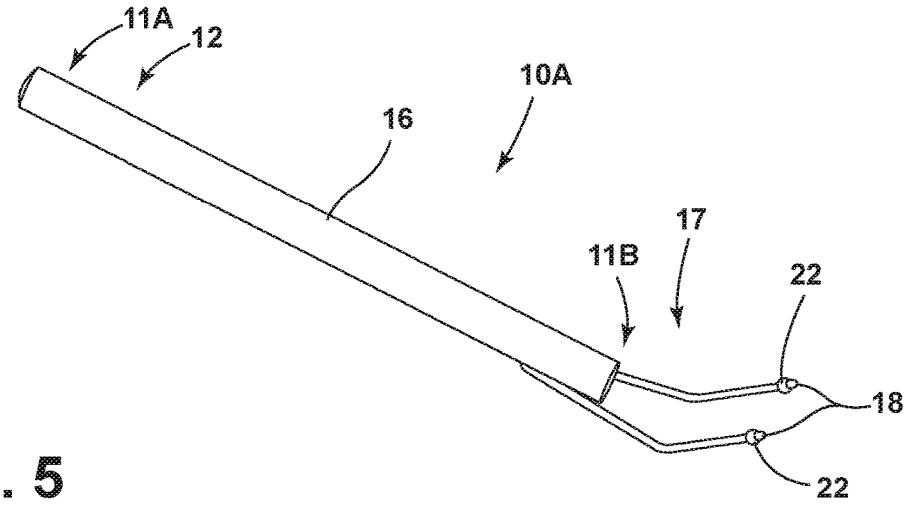
FIG. 5 is a perspective view of a tool for manipulating a bed covering according to another embodiment.
Figure 6:
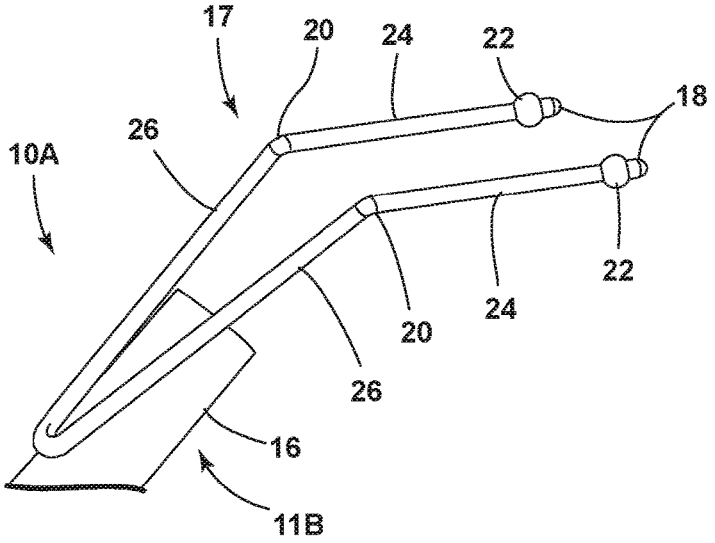
FIG. 6 is a fragmentary enlarged perspective view of a distal end of the tool of FIG. 5.
Figure 7:
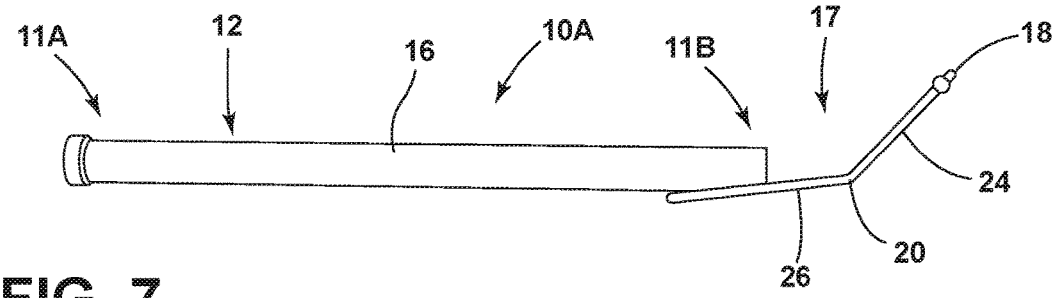
FIG. 7 is a side elevational view of the tool of FIG. 5.

Another embodiment of a tool 10A is shown in FIGS. 5-7. In this embodiment, the tool 10A does not include a grip and the cover manipulating portion 17 is connected to the shaft 16 without fasteners, such as by welding. In this embodiment, the proximal handle portion 12 is solely on shaft 16. Description of similar portions of the tool 10A as compared to tool 10 is omitted for the sake of brevity.

Figure 8:
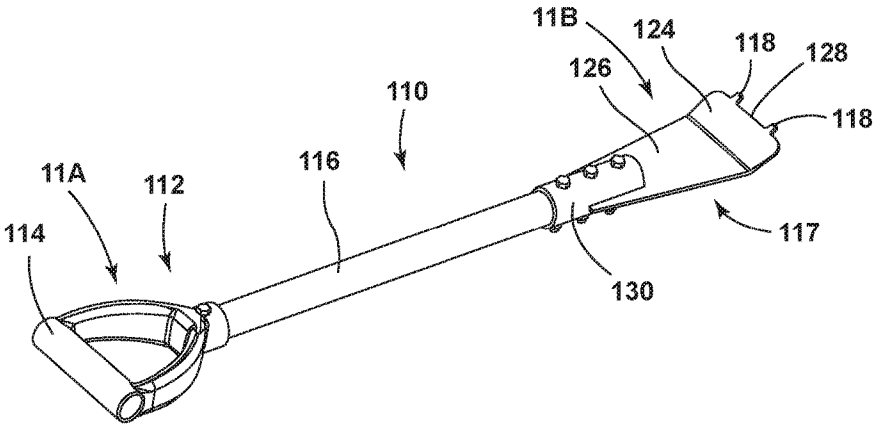
FIG. 8 is a perspective view of a tool for manipulating a bed covering according to another embodiment.
Figure 9:
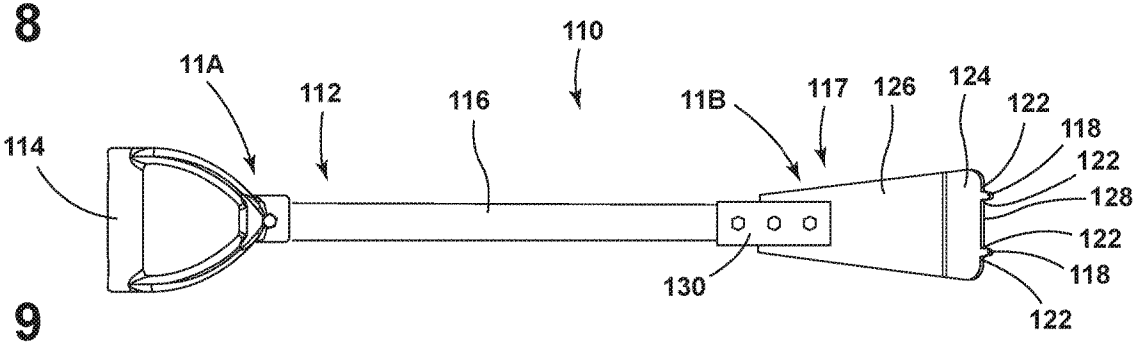
FIG. 9 is a top plan view of the tool of FIG. 8.
Figure 10:
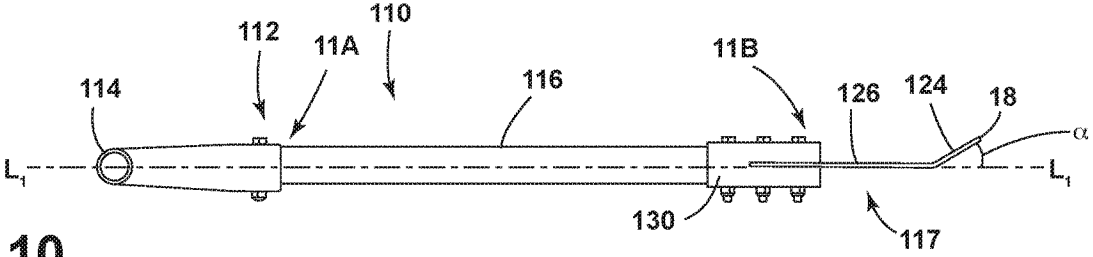
FIG. 10 is a side elevational view of the tool of FIG. 8.

The end stop portions 22 may take a variety of forms, such as end stop portions 122 of a cover manipulating portion 117 adjacent the spaced-apart protrusions 118 as shown in FIGS. 8-10. Alternatively the spaced-apart protrusions 18, 118 themselves could have a gradually enlarged profile such that portions of the exterior surfaces of the protrusions themselves form the end stop portions. Naturally, in some embodiments, the location of the end stop portions may vary depending on the size of the openings in the cover and the size of the spaced-apart protrusions.

As may be apparent, the spaced-apart protrusions and the end stop portions are preferably sized and configured such that the protrusions 18, 118 are only capable of protruding through the openings in the cover as far as needed to provide effective retention and control of the bed covering without the bed covering easily disengaging the protrusions 18, 118 while the bed covering is being manipulated. In one form, the length of the protrusions 18, 118 from their tips to the end stop portions 22, 122, respectively, is approximately ⅜ of an inch. However, a variety of lengths are contemplated, with longer lengths making it less likely that the bed covering will inadvertently fall off of the protrusions 18, 118, while potentially increasing the difficulty of removing the bed covering from the protrusions. Preferably, the length of each protrusion 18, 118 is under two inches, and more preferably one inch or less.

The spaced-apart protrusions 18, 118 are preferably oriented at an angle with respect to the tool axis, which as shown in the disclosed embodiments is the longitudinal axis of the shaft 16, 116 (labeled $L_1$ in FIG. 10). The cover manipulating portion 17, 117 may also include an inclined portion 24, 124 which is configured for being inserted between a mattress and a mattress support surface, such as a box spring 270 (FIG. 11) or an upper support surface of a bed. The inclined portion 24 permits the user to use the tool 10, 10A, 110 more comfortably and reduces the need to bend over to place the bed covering about a mattress. The inclined portion 24, 124 may have a wide range of angles α (FIG. 10) with respect to the tool axis $L_1$. For example, the inclined portion 124 in FIGS. 8-10 extends at approximately a 30 degree angle with respect to the tool longitudinal axis $L_1$. The embodiments disclosed in FIGS. 1-7 include an inclined portion 24 extending at an angle of approximately 55 degrees with respect to the tool longitudinal axis $L_1$. However, the inclined portion 24, 124 preferably has an orientation between 0 and 75 degrees with respect to the tool longitudinal axis. Although not shown, the protrusions 18, 118 may be inclined with respect to the inclined portion 24, 124, or the inclined portion may be omitted entirely.

The cover manipulating portion 17, 117 also includes a transition portion 26, 126 between the inclined portion 24, 124 and the shaft 16, 116 that may be used as an inclined surface similar to a wedge to lift or pry a mattress when the inclined portion 24, 124 is inserted under the mattress. Such a configuration can be helpful to tuck sheets more deeply under the mattress to more securely position the sheet or sheets about the mattress.

In FIGS. 8-10, an alternate embodiment of a cover manipulating tool 110 is depicted. The proximal handle portion 112, grip 114, and shaft 116 are similar to the embodiment of FIGS. 1-4. However, the cover manipulating portion 117 at the distal end 11B of shaft 116 has a shovel or spatula-like configuration instead of separate spaced-apart tines 20. In particular, the cover manipulating portion 117 includes a substantially planar plate-like inclined portion 124 and substantially planar plate-like transition portion 126. Spaced-apart projections 118 extend from a distal end surface 128 of the inclined portion 124. The projections 118 are approximately 2 inches apart from one another, however other spacings may be used as would be apparent to one of ordinary skill. The projections 118 have a slight taper, such that they are narrower at their distal ends. Although a pair of projections 118 is shown in this and the other disclosed embodiments, other numbers of projections may be used, such as one or three projections. In FIGS. 8-10, the cover manipulating portion 117 is connected to the shaft 116 via socket 130 and fasteners.

Figure 11:
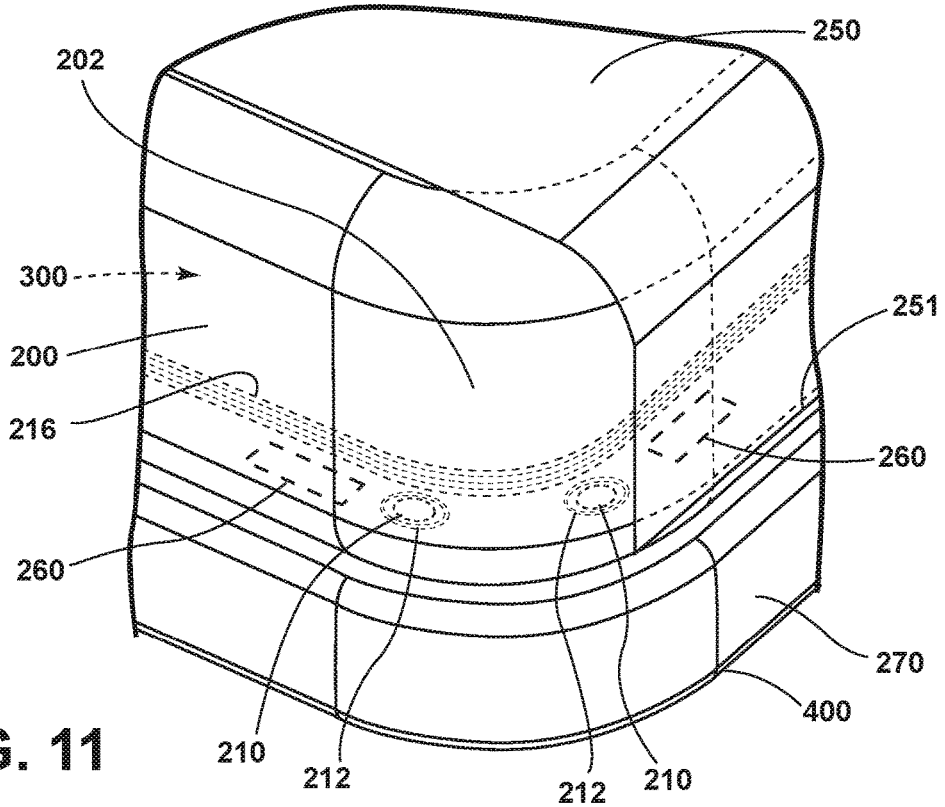
FIG. 11 is a fragmentary enlarged perspective view of a corner portion of a bed covering surrounding a mattress.
Figure 12:
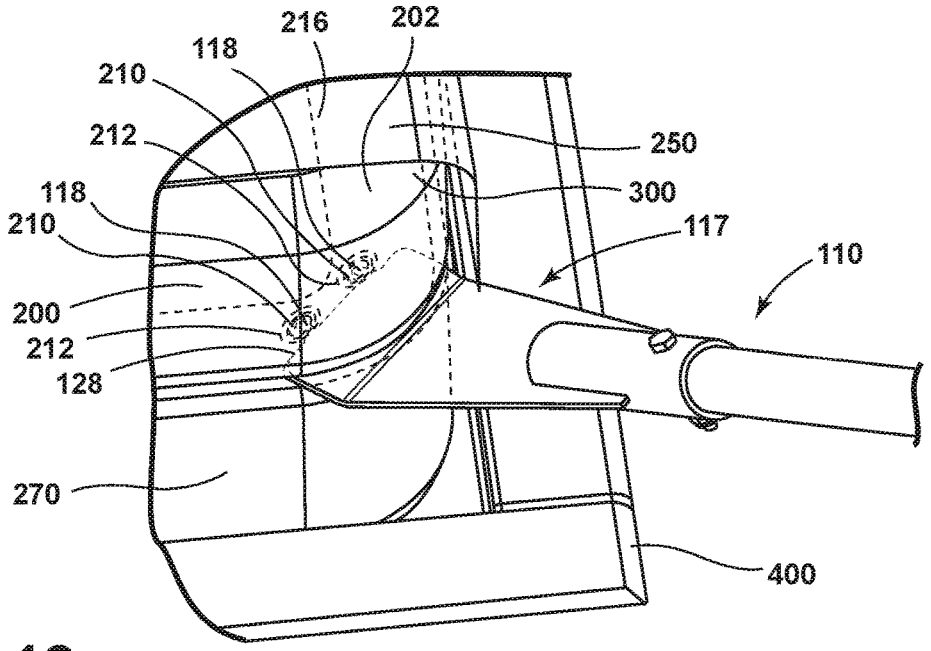
FIG. 12 is a perspective view of a corner portion of a bed covering being tucked under a mattress using the tool of FIG. 8.
Figure 20:
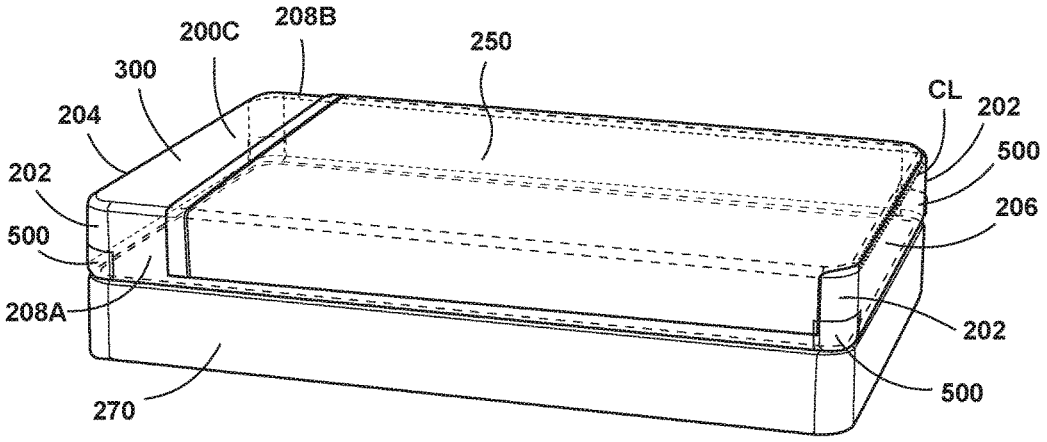
FIG. 20 is a perspective view of a bed covering according to another embodiment covering a bed.

A corner portion 202 of a bed covering in accordance with the present invention is shown in FIGS. 11-12. In one form, the bed covering is a fitted sheet 200 with a tool receiving portion in the form of a pair of spaced-apart openings 210 formed in corner portion of the sheet 200. In one form, the openings 210 are surrounded by grommets 212 to reinforce the structure of the openings 210. Preferably, the openings 210 are formed near a bottom edge 216 of the sheet 200 so that the cover manipulating tool 10, 110 may position the bottom edge 216 of the sheet underneath the mattress 300 to achieve a proper fit. A top or flat sheet 250 may be sewn or otherwise coupled to the fitted sheet 200 to provide a composite sheet as shown in FIG. 20. The top sheet 250 may be attached to the fitted sheet 200 near the bottom edge 216 corresponding with the foot of a bed 400, along the foot edge 251 of the top sheet 250. Alternatively, the top sheet 250 can be attached to the fitted sheet 200 adjacent and spaced from the bottom edge 216. Either the fitted sheet 200 or a separate or connected top sheet 200, 250 or both of the sheets 200, 250 may be provided with a hook and loop fastener 260 attached near a lower edge for releasably attaching one or both of the sheets 200, 250 to one another or to a mattress support surface having a corresponding hook and loop fastener, such as a box spring 270 or upper bed support surface.

A tool 110 for manipulating a bed covering 200 is shown in FIG. 12 with the spaced-apart protrusions 118 disposed in the openings 210 with the bed covering 200 disposed about a mattress 300. To place the bed covering 200 about the mattress 300, a user may first place the bed covering 200 on top of the mattress 300 and then engage one of the corner portions of the bed covering 200 with the spaced-apart protrusions 118 by inserting the protrusions 118 into the openings 210. Alternatively, the user may first engage a corner portion of the bed covering 200 with the tool 110 before placing the bed covering 200 on top of the mattress 300. With the bed covering 200 disposed on the distal end 128 of the tool 110, the lower edge 216 of the bed covering 200 may then be tucked around and underneath the corner of the mattress 300. The protrusions 118 may then be removed from the openings 210, leaving the bed covering 200 in place. The method may then be repeated for each corner portion of the bed covering 200.

Figure 13:
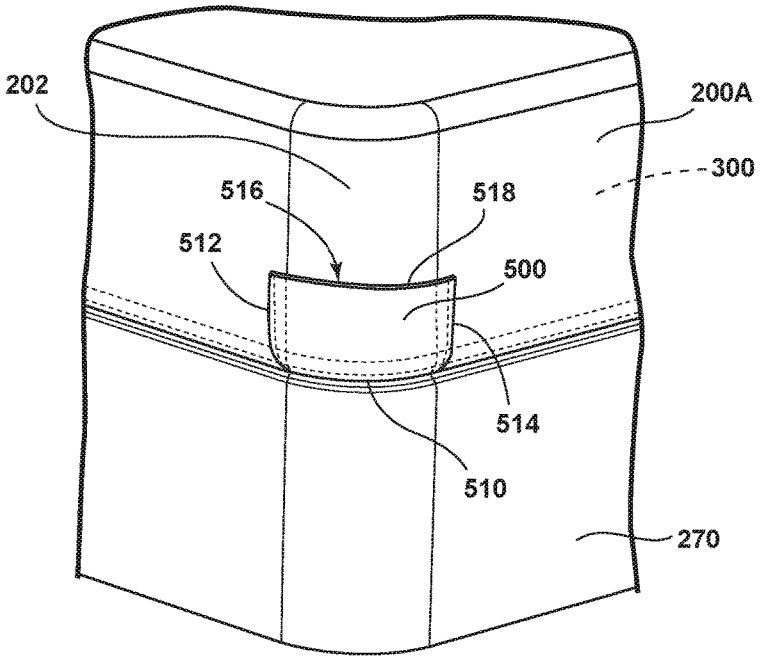
FIG. 13 is a fragmentary perspective view of a corner portion of an alternate embodiment of a bed covering including a tool receiving portion in the form of a pocket.
Figure 14A:
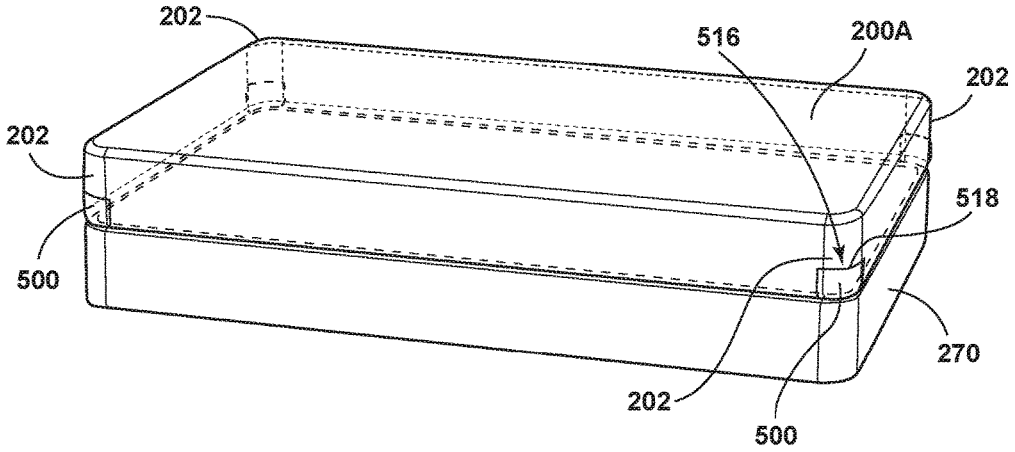
FIG. 14A is a perspective view of the bed covering of FIG. 13 covering a bed.

In another embodiment, the bed covering 200A may have a tool receiving portion in the form of a pocket 500 located at each corner portion 202 of the bed covering 200, as shown in FIGS. 13 and 14A. The pocket 500 is configured to receive the distal cover engaging portion of an installation tool, such as one of the engaging portions of the tools disclosed in FIGS. 1-10. Alternatively, the user may use their hand or another object to manipulate the bed covering 200A by inserting and temporarily capturing their hand, tool, or object within an opening or interior 516 of the pocket 500. The pocket 500 has a top edge 518 and a bottom edge 510 between opposite lateral side edges 512, 514. The bottom edge 510 and opposite lateral side edges 512, 514 are sewn or otherwise coupled to the bed covering 200 to form the opening or pocket interior 516 for receiving a tool or hand. The relatively larger opening 516 eases insertion of the tool into the pocket 500. In one form, the side edges 512, 514 of pockets 500 are approximately three inches long and the top and bottom edges 518, 510 are approximately five inches wide. The pockets 500 could advantageously be provided separately to allow the user to retrofit existing bed covers by sewing or otherwise coupling the pockets 500 to the existing bed cover. Preferably, the pockets 500 are made out of the same material as the bed covering 200, although other materials may be used. Although the pocket 500 is shown located at the corner portions of the bed cover 200, the pockets 500 may be partially or completely tucked under the mattress 300 when the bed covering 200 is fully received on the mattress 300 by a user.

Figure 14B:
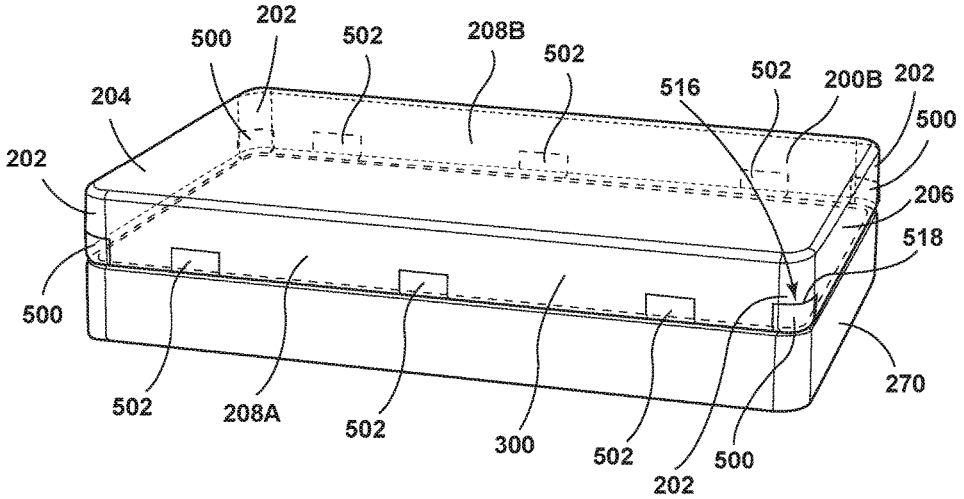
FIG. 14B is a perspective view of a bed covering according to another embodiment covering a bed.
Figure 15:
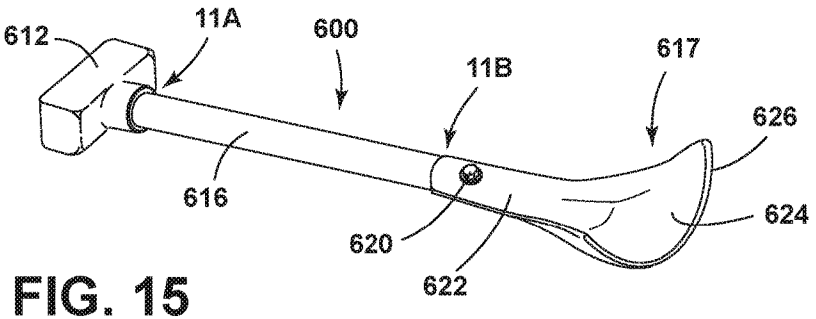
FIG. 15 is a perspective view of a tool for manipulating a bed covering according to another embodiment.
Figure 16:
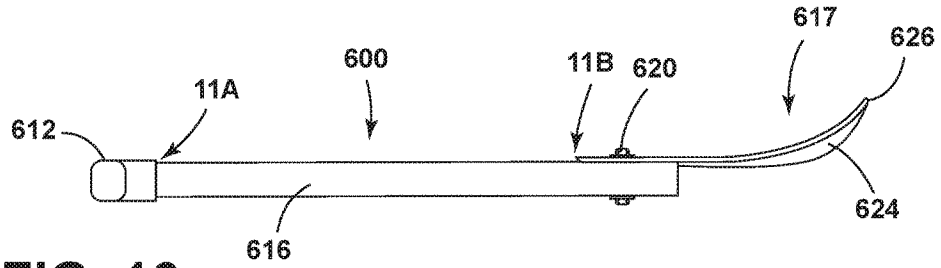
FIG. 16 is a side elevational view of the tool of FIG. 15.
Figure 18:
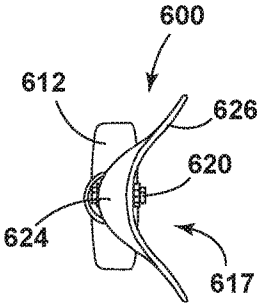
FIG. 18 is an end view of the tool of FIG. 15.
Figure 17:
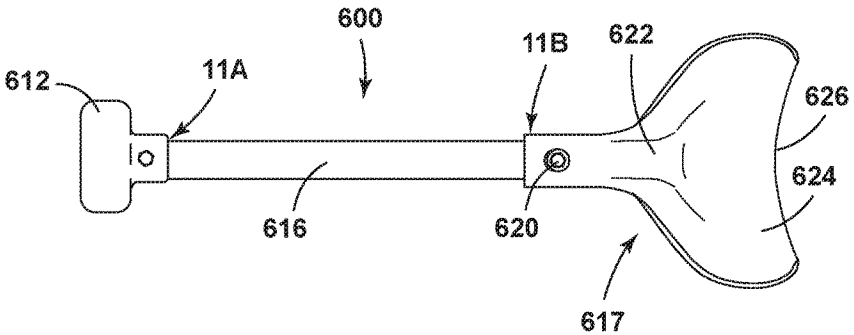
FIG. 17 is a bottom plan view of the tool of FIG. 15.

With reference to FIG. 14B, a bed covering 200B is shown having pockets 500 disposed in the corner portions 202 of the bed covering 200B. The bed covering 200B further includes a top portion 204, a bottom portion 206 and oppositely disposed side portions 208A, 208B. Along the side portions 208A, 208B, intermediate pockets 502 are shown which are configured to receive the cover engaging portion of an installation tool, such as one of the tools disclosed in FIGS. 1-10. In this way, the side portions 208A, 208B can also be tucked into the spacing between the mattress 300 and the box spring 270. Any number of intermediate pockets 502 can be disposed along the side portions 208A, 208B and may also be disposed along the top and bottom portions 204, 206 as necessary for providing a multitude of tool receiving areas along the bed sheet 200B.

Referring now to FIGS. 15-18, a tool 600 for manipulating a bed covering is shown, wherein the tool 600 includes a handle portion 612 disposed on an elongate shaft 616. The shaft 616 includes a proximal end 11A and a distal end 11B, wherein the distal end 11B includes a cover manipulating portion 617. The cover manipulating portion 617 is coupled to the shaft 616 via a fastener 620. In the embodiment shown in FIGS. 15-18, the cover manipulating portion 617 of tool 600 includes a body portion 622 that tapers outwardly to define a shovel nosed end 624 having an arched outermost edge 626. The tool 600 shown in FIGS. 15-18 can be used to engage a pocket, such as pockets 500 and 502 shown in FIG. 14B, to properly position the bed covering 200B on a mattress 300. Use of the tool 600 for positioning the bed sheet 200B is further described below with reference to FIG. 19.

Figure 19:
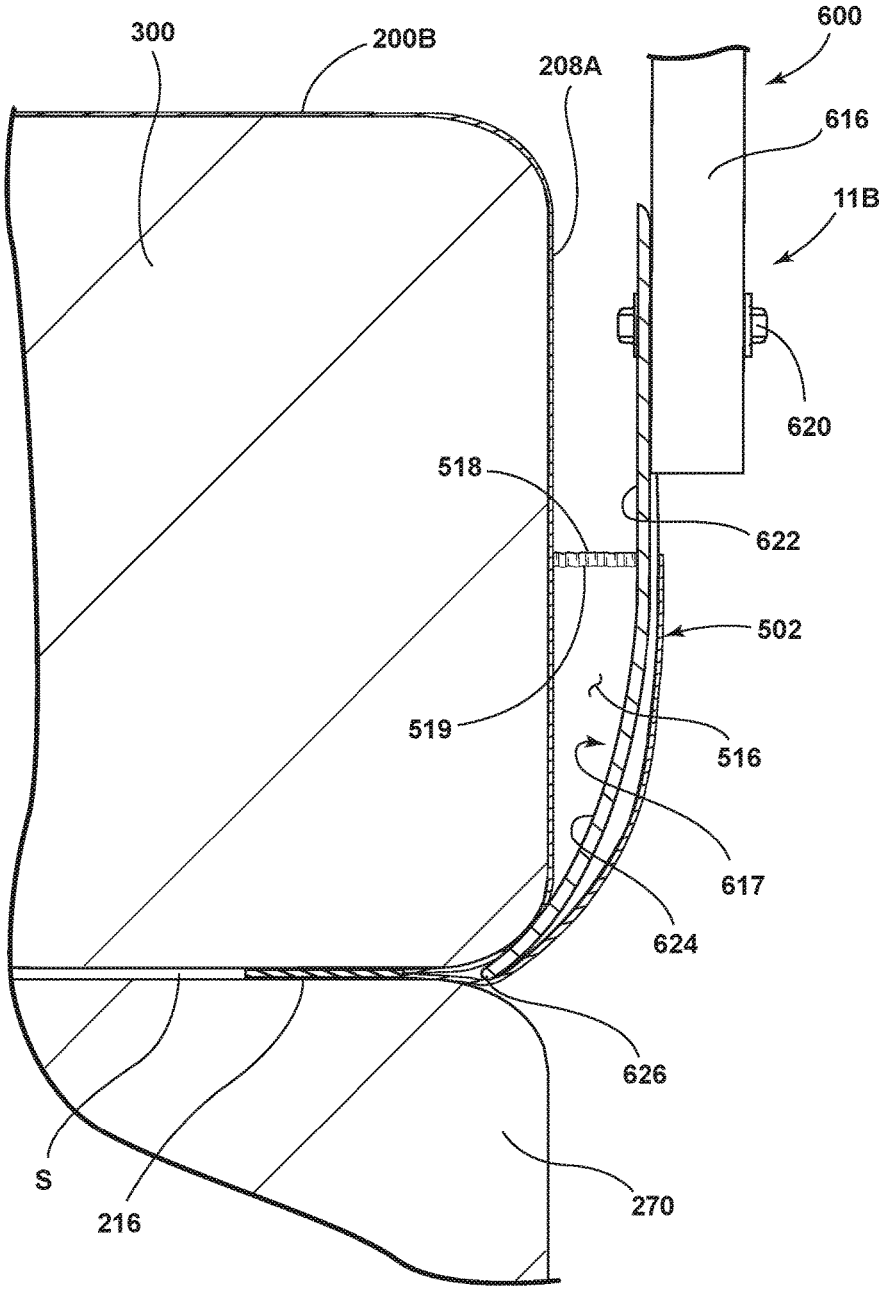
FIG. 19 is a cross-sectional view of a bed covering being tucked under a mattress using the tool of FIG. 15.

Referring now to FIG. 19, a cross-sectional view of the bed covering 200B, mattress 300 and box spring 270 is shown with a spacing S disposed between the mattress 300 and box spring 270. The tool 600 is shown with the cover engaging portion 617 positioned within an interior 516 of pocket 502. Pocket 502 is an intermediary pocket disposed along a side portion 208A of the bed covering 200B. However, it is contemplated that the tool 600 can also be used for any of the corner pockets 500 shown in FIG. 14B. The shovel nosed end 624 is shown positioned within the interior portion 516 of the pocket 502, and the angle of the body portion 622 to the arched distal end 626 is shown as positioning the distal end 216 of the bed covering 200B into the spacing S between the mattress 300 and box spring 270. With the tool 600 engaged with the pocket 502, the pocket 502 is pulled away from the side portion 208A of the bed covering 200B. The top edge 518 of the pocket 502 is shown having an elastic band 519 coupled thereto which is configured to flexibly and resiliently bias the pocket 502 back towards a flat position against the side portion 208A when the cover engaging portion 617 of the tool 600 is removed from the pocket 502. It is further contemplated that the distal edge 216 of the bed covering 200B may include a rubberized material configured to grip either an underside of the mattress 300, a top side of the box spring 270 or both once the distal end 216 is properly placed in the spacing S between the mattress 300 and the box spring 270.

Referring now to FIG. 20, a bed covering 200C has a similar configuration to bed covering 200B, but further includes a top sheet 250 coupled near the bottom portion 206 of the bed covering 200C along a coupling line CL. In this way, when a user positions the bed covering 200C to the mattress 300, the top sheet 250 is also fitted thereto, such that the user is spared from a similar top sheet fitting procedure.

Figure 21:
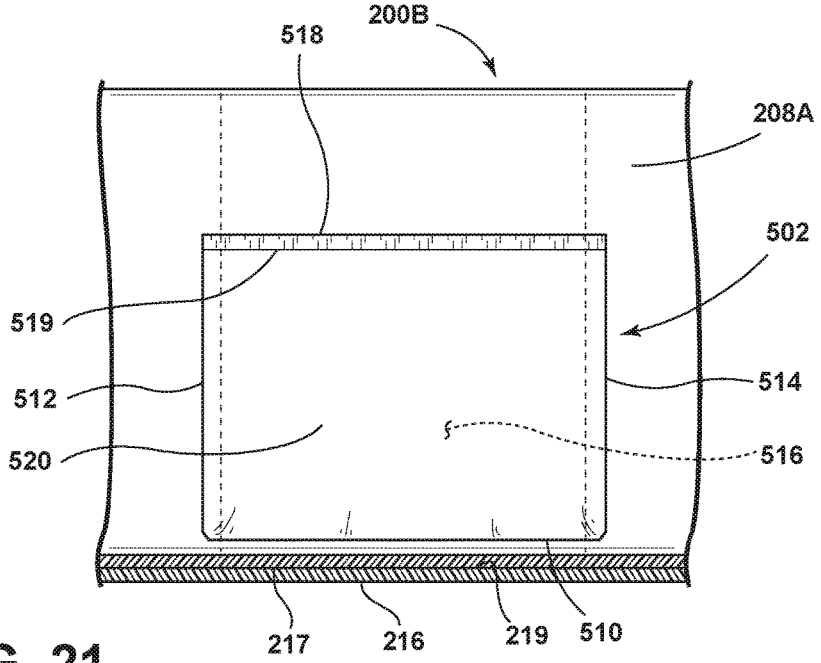
FIG. 21 is a side elevational view of a tool receiving portion of a bed covering in the form of a pocket.

Referring now to FIG. 21, an intermediary pocket 502 is shown disposed on side portion 208A of bed covering 200B. The intermediary pocket 502 includes a top edge 518 having elastic band 519 coupled thereto. The body portion 520 of the pocket 502 is coupled to the side portion 208A of the bed covering 200B along side edges 512, 514 and bottom edge 510. In this way, an interior 516 of the pocket 502 is formed between the body portion 520 of the pocket 502 and the side portion 208A of the bed covering 200B. In the embodiment shown in FIG. 21, the bed covering 200B includes a distal end 216 which is meant to be tucked under a mattress, such as mattress 300, in use. The distal end 216 of the bed covering 20B includes an elastic portion 217 which may surround an entirety of the distal end 216, such that the bed covering 200B is a fitted sheet. The distal end 216 further includes an engagement portion 219 which may be a rubberized or foam like engagement feature that is contemplated to be disposed on the distal end 216 of the bed covering 200B to provide grip against a mattress, a box spring, or both when the distal end 216 is tucked into position, such as in a manner shown in FIG. 19. In this way, when properly placed on a mattress, the bed covering 200B is configured to stay properly positioned in an effort to reduce the need for adjustments in use.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A tool for manipulating a bed covering, comprising:

a proximal handle portion;

a distal end portion comprising a plurality of spaced-apart protrusions extending outwardly therefrom, wherein the spaced-apart protrusions are configured to engage and extend through a plurality of openings in said bed covering to manipulate said bed covering; and end stop portions disposed directly adjacent to the spaced-apart protrusions sized and configured for abutting with said bed covering adjacent to the openings of said bed covering to limit how far the protrusions can extend through the openings.

2. The tool according to claim 1, further comprising a shaft portion extending between the proximal handle portion and the distal end portion.

3. The tool according to claim 1, wherein the distal end portion comprises a pair of tines that extend away from the distal end portion and terminate in the spaced-apart protrusions.

4. The tool according to claim 1, wherein a longitudinal axis is defined between the proximal handle portion and the distal end portion, and further wherein the protrusions extend in a reference plane transverse to the longitudinal axis.

5. The tool according to claim 1, wherein the pair of spaced-apart protrusions include distal tips and the distance from the distal tips to the end stop portions is one inch or less.

6. The tool according to claim 2, wherein the shaft portion extends along a longitudinal axis and the distal end portion further comprises a transition portion located proximally of the pair of spaced-apart protrusions, wherein the transition portion extends transversely to the longitudinal axis of the shaft portion.

7. The tool according to claim 1, wherein each of the spaced-apart protrusions has a width, and each end stop portion has an arcuate configuration and a width greater than the width of an adjacent spaced-apart protrusion.

* * * * *